United States Patent [19]

Edwards

[11] 4,021,974

[45] May 10, 1977

[54] CAMOUFLAGE DISRUPTER FRAME

[75] Inventor: Wayland C. Edwards, Garland, Tex.

[73] Assignee: Varo, Inc., Garland, Tex.

[22] Filed: Mar. 5, 1976

[21] Appl. No.: 664,271

[52] U.S. Cl. ..... 52/63; 52/109; 52/633; 135/1 R; 135/3 R; 135/4 R

[51] Int. Cl.[2] ..... E04B 1/347; A45F 1/04

[58] Field of Search ..... 135/1 R, 3 R, 4 R; 52/109, 63, 633; 428/919

[56] References Cited

UNITED STATES PATENTS

| | | | |
|---|---|---|---|
| 1,608,242 | 11/1926 | Sava | 135/4 R |
| 3,374,798 | 3/1968 | Samuelson | 428/919 |
| 3,710,806 | 1/1973 | Kelly | 52/109 |
| 3,830,031 | 8/1974 | Soisson | 52/109 |

FOREIGN PATENTS OR APPLICATIONS

| | | | |
|---|---|---|---|
| 254,973 | 1/1950 | Switzerland | 135/1 R |

OTHER PUBLICATIONS

A. P. C. Application of Schwimmer and Quittner, Ser. No. 378,286, Published Apr. 27, 1943.

*Primary Examiner*—Price C. Faw, Jr.

*Assistant Examiner*—James L. Ridgill, Jr.

*Attorney, Agent, or Firm*—Richards, Harris & Medlock

[57] ABSTRACT

The specification discloses a camouflage disrupter frame for supporting camouflage netting in order to camouflage an object. The disrupter frame includes a plurality of elongated links pivotally interconnected at the ends thereof to form a parallelogram configuration when the frame is expanded from a normally closed position to an open position. An elongated flexible bow member is connected across the frame and has a linear configuration when the frame is closed. The flexible bow member is flexed and bent outwardly from the parallelogram configuration when the frame is expanded to the open position. When the bow member is flexed, the bow member tends to return the frame to the closed position. A strap is adapted to be connected across a corner of the frame to prevent the return of the frame to the closed position. A camouflage netting may be attached to and supported by the disrupter frame to provide anirregular three dimensional camouflage shape. When not in use, the strap may be disconnected and the frame is then moved to the closed position due to the unflexing of the bow member for ease of storage.

18 Claims, 9 Drawing Figures

CAMOUFLAGE DISRUPTER FRAME

FIELD OF THE INVENTION

This invention relates to camouflage techniques, and more particularly relates to an extendable camouflage disrupter system.

THE PRIOR ART

Various camouflage techniques have been heretofore developed for use in military situations. For example, it is necessary to provide camouflaging for military vehicles such as trucks and also for artillery, radar sets and the like. One prior type of camouflage utilizes a tent or other device to completely cover or hide the object to be camouflaged. Another type of camouflaging utilizes disrupters which do not totally conceal an object, but which disguise the shape of the object by breaking up the lines which define the shape of the object. Camouflage disrupters have been heretofore proposed which include folding structures for supporting camouflage netting. However, previously developed disrupter frames have been complex in structure and operation and therefore expensive and not durable in use. A need has thus arisen for a disrupter frame which is lightweight, relatively simple in construction and operation and inexpensive, yet which is extremely durable and which provides a non-uniform three dimensional frame for supporting camouflage netting.

SUMMARY OF THE INVENTION

In accordance with the present invention, a camouflage disrupter includes a frame having a plurality of pivotally connected links movable between closed and open positions. The links define a predetermined planar geometric shape in the open position. Structure is connected to the frame and is movable to a position away from the planar geometric shape to provide a three dimensional disrupter frame when the links are in the open position.

In accordance with another aspect of the invention, a camouflage disrupter includes a frame having a plurality of elongated links pivotally interconnected at the ends thereof and movable between closed and open positions. The links fold to a compact configuration in the closed position and form a predetermined geometric shape in the open position. A bow is connected to the frame and has a flattened configuration in the closed position. The effective length of the bow is reduced in the open position such that the bow is bent outwardly away from the geometric shape to provide a three dimensional disrupter frame.

In accordance with a more specific aspect of the invention, a camouflage disrupter frame for being attached to an object to be camouflaged includes a plurality of elongated links pivotally interconnected at the ends thereof to form a diamond shaped configuration when the frame is expanded from a closed position to an open position. An elongated flexible bow member normally has a linear shape and is connected across the frame. A flexible bow member is flexed outwardly from the geometric configuration when the frame is expanded to the open position. The flexible member, when flexed, tends to return the frame to the closed position. A strap is connectable across the frame to prevent the return of the frame to the closed position.

DESCRIPTION OF THE PREFERRED EMBODIMENT

Figure 1:
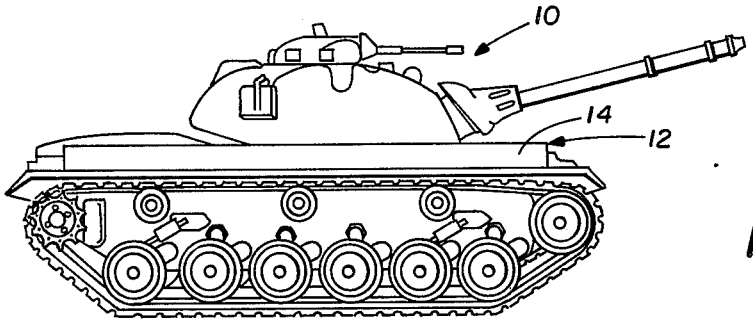
FIG. 1 is a somewhat diagrammatic illustration of a military vehicle including the present disrupter frame in its closed position within a housing.

FIG. 1 illustrates a conventional tank vehicle 10 used in military operations. Due to the distinctive shape of the tank 10, it is desirable to provide camouflage to break up the lines of the tank. For this purpose, the tank carries a camouflage housing 12 along each side thereof. The housing 12 has a rectangular cross section and includes a side door 14 which is hinged for operation between open and closed positions. When the tank 10 is operating without the need for camouflage, the camouflage apparatus is maintained within the housing 12 and the door 14 is closed. In this manner, the camouflage apparatus is maintained away from the moving tracks of the tank and does not interfere with normal operation of the tank.

Figure 2:
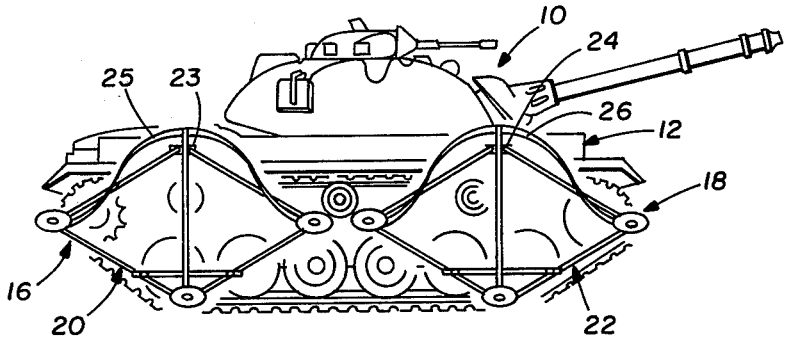
FIG. 2 is a somewhat diagrammatic illustration illustrating two of the disrupter frames of the invention in their opened configurations.

When it is desired to employ camouflage, the door 14 is moved to its open position and the camouflage disrupter frames 16 and 18 of the present invention are extended as shown in FIG. 2. Disrupter frames 16 and 18 comprise generally rigid diamond-shaped frames 20 and 22 connected to housing 12 by support members 23 and 24. Frames 16 and 18 also include upwardly extending bow members 25 and 26 which provide an irregular three dimensional framework. When employed in the illustrated expanded position, the disrupter frames 16 and 18 provide a stable and secure disrupter frame for supporting camouflage netting or other camouflage devices.

Figure 3:
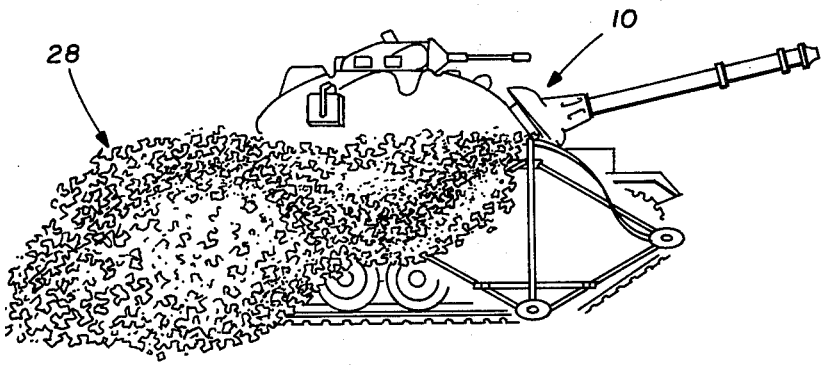
FIG. 3 is a somewhat diagrammatic illustration showing a camouflage netting disposed over a disrupter frame shown in FIG. 2.

FIG. 3 illustrates the tank 10 when a conventional camouflage netting 28 is applied over the disrupter frames 16 and 18. Netting 28 is shown only partially covering frame 18 for clarity of illustration. The camouflage netting may be of conventional construction including colored flexible plastic sheets cut in irregular shapes and supported by a rope mesh. When not in use, the camouflage netting will be stored in the housing 12 along with the retracted disrupter frames 16 and 18. As shown in FIG. 3, when the present camouflage disrupter and netting are employed, the distinctive shape of the tank 10 is distorted and therefore camouflaged.

Camouflage netting 28 may be specially constructed so as to also provide camouflaging effect in the infra-red and radar spectrums.

Figure 4:
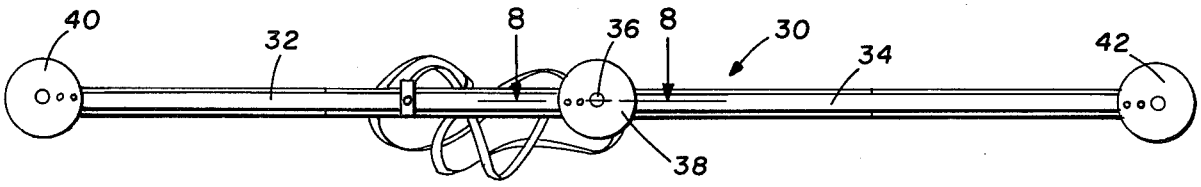
FIG. 4 is a top view of one of the disrupter frames in the closed position.

FIG. 4 illustrates one of the disrupter frames generally identified by numeral 30 in its retracted position. The disrupter frame comprises links 32 and 34 pivotally attached to one another at a pivot 36. A round plate 38 is attached at the pivot location to prevent snagging of the disrupter frame on the camouflage netting. Similarly, circular plates 40 and 42 are attached at the ends of the links to prevent snagging.

Figure 5:
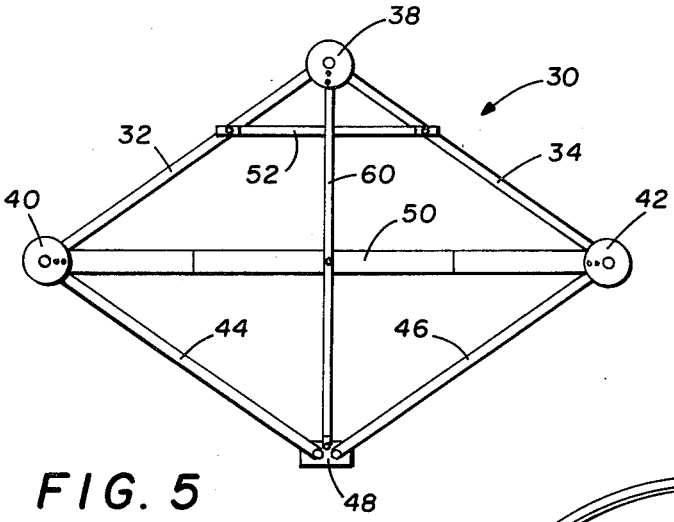
FIG. 5 is a top view of the disrupter frame in the open position.

FIG. 5 illustrates the disrupter frame 30 in its expanded position. Additional links 44 and 46 are shown to be pivotally connected to a support member 48 which may be attached to a military vehicle. The end of link 44 is pivotally connected to the end of link 32, while the end of link 46 is pivotally connected to the end of link 34.

A bow member 50 is connected at one end to the juncture of links 32 and 44 and at its other end to the juncture of links 34 and 46. In the retracted position shown in FIG. 4, the bow member is provided with a linear configuration. However, when the disrupter frame 30 is moved to its expanded position, the bow member 50 is distorted because its effective length is shortened.

Figure 6:
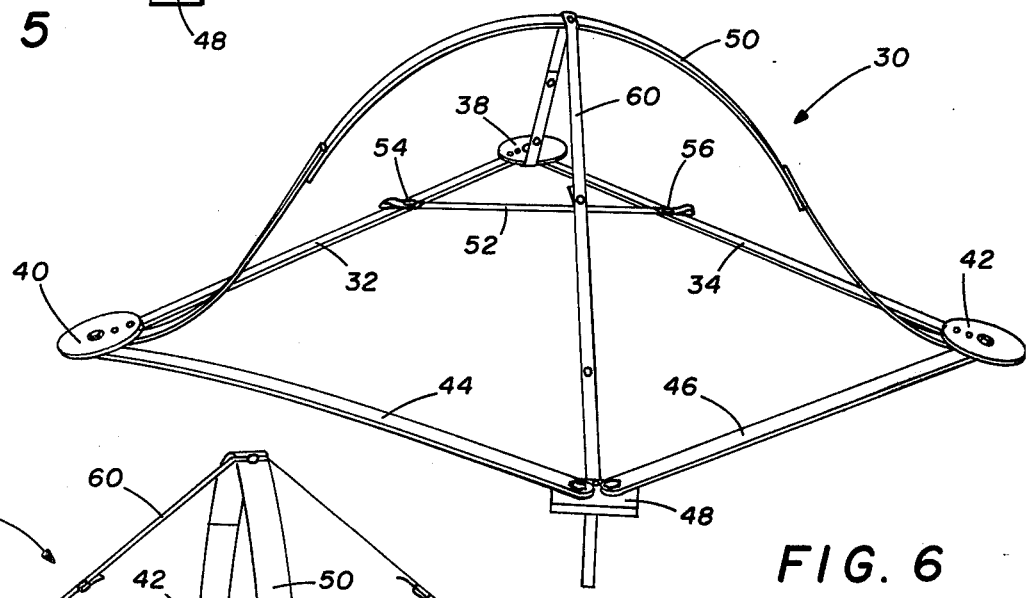
FIG. 6 is a perspective view of the disrupter frame in the open position.

FIG. 6 illustrates a side view of the bow member 50 when in its distorted position. The bow member 50 is constructed from flexible material such as fiberglass or the like so that it may be distorted without breaking. When the bow member 50 is distorted in the manner shown in FIG. 6, it exerts a force which tends to move the disrupter frame 30 back to its retracted or closed position. To prevent this from occurring, a flexible strap 52 is connected across links 32 and 34. Preferably, strap 52 comprises a fiber strap having snappers 54 and 56 which snap on to snap forms on links 32 and 34.

In order to provide stability to the bow member 50, a flexible strap 60 is provided. Strap 60 is connected at one end beneath the plate 38 and at its other end to the support member 48. Strap 60 is also attached to the bow 50 and the strap 60 is drawn tight over the bow 50 when the disrupter frame is in the expanded position to therefore stabilize and provide strength to the bow 50.

Figure 7:
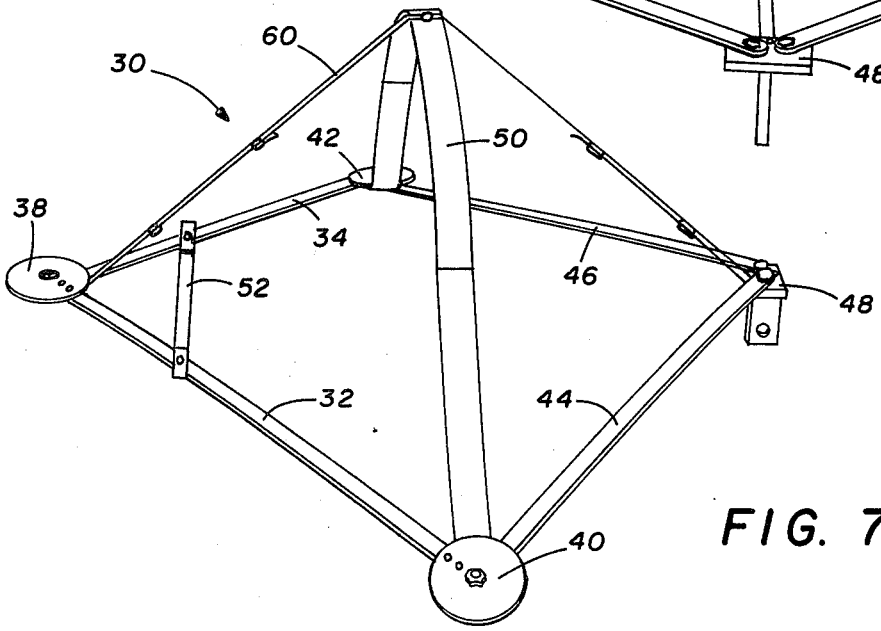
FIG. 7 is another perspective view of the disrupter frame in the open position.

FIG. 7 illustrates a side view of the disrupter frame 30 when in its expanded position and illustrates how the strap 60 is directed over the bow 50. The links 32, 34, 44 and 46 are preferably constructed from flexible material such as fiberglass such that the links will tend to bend downwardly due to the weight of the entire frame when in the expanded position. As shown in FIG. 2, the disrupter frames 16 and 18 will thus tend to bend slightly downwardly in the expanded position to provide a three dimensional frame shape to provide camouflage cover for an object.

Figure 8:
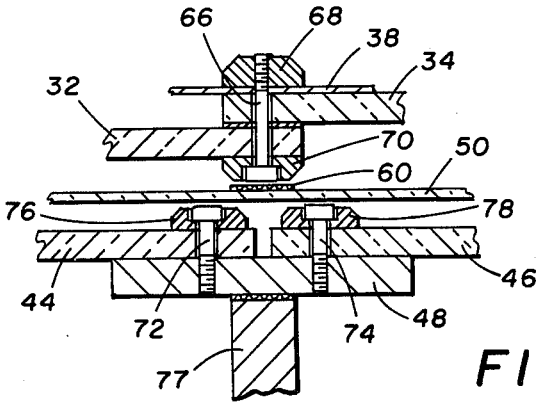
FIG. 8 is a sectional view partially broken away, of the disrupter frame in the closed position taken generally along the section lines 8—8 in FIG. 4.

FIG. 8 is a sectional view taken generally along the section lines 8—8 in FIG. 4 and illustrates the pivotal connection of the present disrupter frame. Links 32 and 34 are pivotally connected by a bolt 66 which extends through apertures in the ends of the links. The end of the bolt 66 is threaded to engage a threaded nut 68. A hex nut 70 receives the head of the bolt 66 in a counterbore portion in order that there are no sharp edge projections which might tend to catch on the camouflage netting. The shoulders of the nuts 68 and 70 are beveled to minimize catching on the camouflage netting. The bolt 66 is preferably a socket head shoulder bolt or screw. Similar pivot bolt and nut connections are provided for the other link connections of the frame.

When the frame is in the retracted position, the bow member 50 is disposed between the links 32 and 34 and the bottom oriented links 44 and 46. Links 44 and 46 are pivotally connected to the support member 48 by bolts 72 and 74. Nuts 76 and 78 include counterbores for receiving the heads of the bolts 72 and 74 in order to eliminate catching on the camouflage net. The ends of the bolts 72 and 74 are threadedly received by threaded apertures in the support frame 48. The support frame 48 includes a downwardly extending member 77 which may be bolted onto the tank or other object to be camouflaged.

Figure 9:
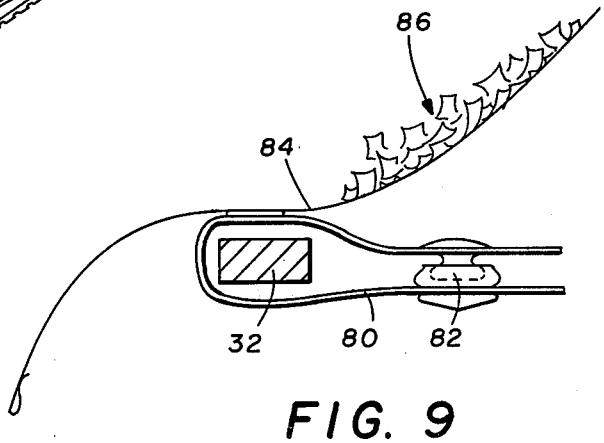
FIG. 9 is a somewhat diagrammatic illustration of the snap apparatus for the camouflage netting shown attached over a sectioned link of the present disrupter frame.

FIG. 9 illustrates the interconnection of the camouflage netting to one of the links 32. A flexible strap 80 includes a conventional snap 82 in order that the strap 80 may be snapped around the link. The camouflage net cord 84 is rigidly attached to the strap 80 and supports the plastic camouflage netting generally identified by numeral 86.

It will be understood that the present invention is useful for camouflaging purposes for a variety of objects such as military vehicles, including tanks, trucks, automobiles and the like, as well as a variety of other military objects such as cannons, radar sets and other electronic equipment and the like.

It will be understood that the present disrupter frame may be constructed in a variety of geometric shapes, although the preferred shape is the illustrated diamond or symmetrical parallelogram configuration. The present links may be connected in other geometrical configurations, with the bow member providing an irregular shaped curve outward from the plane formed by the geometrical configuration to provide a three dimensional camouflage frame.

An important aspect of the frame is that it may be very compactly stored when not in use, and yet may be easily pulled to its expanded position to form a three dimensional irregular shape to provide visual camouflage to the object to which it is attached. When it is desired to move the disrupter frame to its retracted position, the strap 52 is unsnapped at one end and the flexed bow member 50 causes the frame to automatically move to its retracted position as shown in FIG. 4.

Other structure may be utilized in place of the strap 52, such as an over-the-center spring which normally maintains the frame in an open position, but which may be moved to a stable retracted position. In this configuration, the over-the-center spring may be connected in substantially the same location as the strap 52 or in any other suitable location on the frame. It will be understood that the present disrupter frame may be constructed in a plurality of sizes and may be constructed from a variety of material including metal. The links may be formed from curved members rather than linear members as illustrated.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A camouflage disrupter comprising:

a frame including a plurality of pivotally connected links movable between closed and open positions, said links defining a compact configuration when in the closed position and defining a predetermined planar geometric shape when in said open position, and an integral bow member connected at both ends to said frame and normally pivoted at both ends relative to said links for maintaining a planar configuration in a plane parallel to the planes of said frame when in the closed position, said bow member automatically movable to a flexed bent position away from said planar geometric shape of said frame to provide a three dimensional disrupter frame when said links are moved to said open position.

2. The camouflage disrupter of claim 1 wherein said bow member when bent tends to return said links to said closed position, strap means being connectable across said links to maintain said links in said open position.

3. The camouflage disrupter of claim 1 and further comprising:

means for maintaining and stabilizing the bent position of said bow member.

4. The camouflage disrupter of claim 1 wherein said links are pivotally connected to form a parallelogram when in said open position.

5. A camouflage disrupter comprising:

a frame including a plurality of elongated links pivotally interconnected at the ends and movable between closed and open positions, said links folding to a compact configuration in said closed position and forming a predetermined geometric shape in said open position, bow means connected at both ends to said frame and being pivotable relative to said links to have a flattened configuration in said closed position, the effective length of said bow means being reduced in said open position due to movement of said links such that said bow means is bent outwardly away from said geometric shape to provide a three dimensional disrupter frame, and means for attaching said frame to an object to be camouflaged.

6. The camouflage disrupter of claim 5 and further comprising:

camouflage netting disposed over said frame to camouflage the object.

7. The camouflage disrupter of claim 5 wherein said links are interconnected to form a parallelogram when in said open position, said bow means connected across said parallelogram to opposite corners thereof.

8. The camouflage disrupter of claim 7 wherein said bow means when bent tends to move said links to said closed position.

9. The camouflage disrupter of claim 8 and further comprising a strap connected to opposite corners of said parallelogram and extended over said bow means to maintain the position thereof.

10. The camouflage disrupter of claim 8 and further comprising means for preventing return of said links to said closed position.

11. The camouflage disrupter of claim 10 wherein said preventing means comprises an elongate member connected across one corner of said parallelogram.

12. A camouflage disrupter frame for being attached to an object to be camouflaged comprising:

a frame for being connected to the object to be camouflaged and having open and closed positions, said frame including a plurality of elongated links pivotally interconnected at the ends to form a geometric configuration when said frame is expanded to said open position, an elongated flexible member having a linear shape in said closed position connected at both ends across said frame, said flexible member being flexed outwardly from said geometric configuration when said frame is expanded to said open position, said flexible member when flexed tending to return said frame to said closed position, and means connected across said frame for preventing the return of said frame to said closed position.

13. The camouflage disrupter of claim 12 wherein said geometric configuration of said frame comprises a diamond shape.

14. The camouflage disrupter of claim 13 wherein said flexible member is connected to opposite corners of said diamond shape.

15. The camouflage disrupter of claim 13 wherein said preventing means comprises a strap connectable across one corner of said diamond shape.

16. The camouflage disrupter of claim 13 and further comprising:

a flexible strap extending across said diamond shaped frame and contacting said flexible member to stabilize said flexible member.

17. The camouflage disrupter of claim 13 and further comprising:

means to attach a camouflage netting over said disrupter frame to provide an irregular three-dimensional camouflage shape.

18. The camouflage disrupter of claim 17 and further comprising:

a plurality of said disrupter frames mounted in proximity to one another on an object for supporting a camouflage netting.

* * * * *